United States Patent [19]

Hiroishi et al.

[11] 3,949,803

[45] Apr. 13, 1976

[54] METHOD OF CASTING MOLTEN METAL USING MOLD ADDITIVES

[75] Inventors: Makoto Hiroishi; Kazuo Mitsunaga; Yoshiyuki Fujisawa, all of Soja, Japan

[73] Assignee: Foseco International Limited, Birmingham, England

[22] Filed: July 30, 1974

[21] Appl. No.: 493,071

Related U.S. Application Data

[62] Division of Ser. No. 356,138, May 1, 1973, abandoned.

[30] Foreign Application Priority Data

May 1, 1972 Japan ..... 47-44146

[52] U.S. Cl. ..... 164/56; 164/123; 164/82

[51] Int. Cl.[2] ..... B22D 27/20; B22D 27/18

[58] Field of Search ..... 164/73, 82 US, 55, 56, 164/123, 82; 148/26; 75/94

[56] References Cited

UNITED STATES PATENTS

| | | | |
|---|---|---|---|
| 3,239,898 | 3/1966 | Turner | 164/123 |
| 3,625,757 | 12/1971 | Wiehe et al. | 148/26 |
| 3,627,592 | 12/1971 | Schmidt | 148/26 |
| 3,642,052 | 2/1972 | Schrewe et al. | 164/55 |
| 3,649,249 | 3/1972 | Halley et al. | 164/82 |
| 3,677,325 | 7/1972 | Austin | 164/73 |
| 3,704,744 | 12/1972 | Halley et al. | 164/82 |

FOREIGN PATENTS OR APPLICATIONS

| | | | |
|---|---|---|---|
| 1,958,537 | 6/1971 | Germany | 164/55 |

*Primary Examiner*—Ronald J. Shore
*Attorney, Agent, or Firm*—Cushman, Darby & Cushman

[57] ABSTRACT

A mould flux which comprises at least 30% by weight of a mixture comprising:

i. wollastonite;

ii. at least one low melting fluxing agent.

15 Claims, 1 Drawing Figure

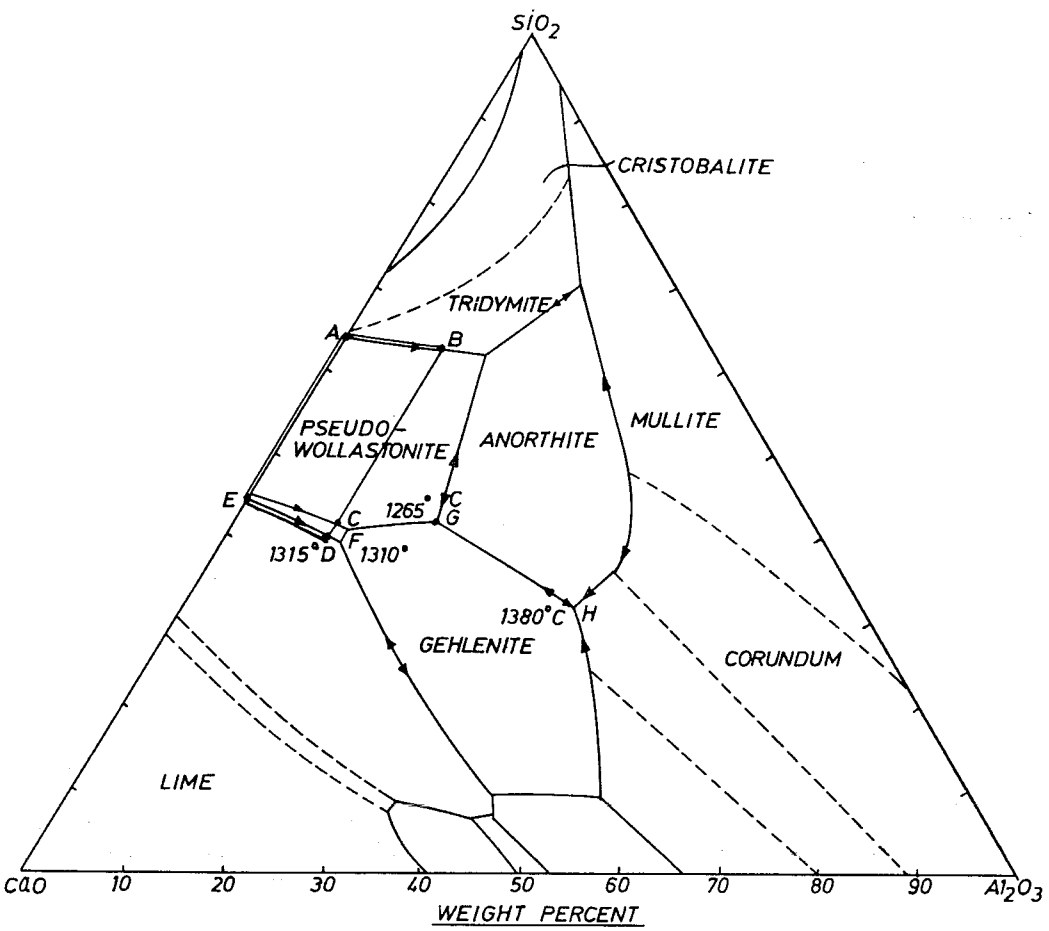
SiO2
CRISTOBALITE
TRIDYMITE
MULLITE
ANORTHITE
PSEUDO-WOLLASTONITE
CORUNDUM
GEHLENITE
LIME
A
B
C
D
E
F
G
H
1265°
1310°
1315°
1380°C
CaO
Al2O3
10
20
30
40
50
60
70
80
90
WEIGHT PERCENT

METHOD OF CASTING MOLTEN METAL USING MOLD ADDITIVES

This is a division of application Ser. No. 356,138, filed May 1, 1973, now abandoned.

The present invention relates to mould fluxes for use in the casting of metals, particularly the continuous casting of steel.

In the casting of molten metals into moulds, a mould flux is generally added to the surface of the molten metal in the mould. The mould flux serves to prevent oxidation of the melt, to insulate the melt, to lubricate between the molten metal and the mould wall and to remove alumina included in the melt.

Conventional mould fluxes generally have fly ash as their main constituent and also contain other ingredients such as cement. However uniformity of quality is difficult to achieve in such fluxes as it is dependent on the quality of the fly ash. Fly ash is obtained from the coal dust obtained from the burning of coal. Its quality thus depends not only on the variety of coal but also on the conditions of burning. Uniformity of quality in a mould flux is of course desirable in order that casting procedures may be standardised.

It has now surprisingly been found that a mixture of specific composition may be used as mould flux.

Accordingly, the present invention provides a mould flux which comprises at least 30% by weight of a mixture comprising:

i. wollastonite;

ii. at least one low melting fluxing agent.

Component (i) may be essentially pure synthetic or natural $CaO.SiO_2$ (though it generally contains very small quantities of iron oxide and alumina); or may be $CaO.SiO_2$ in solid solution with at least one of $SiO_2$, CaO and $Al_2O_3$, for example a solid solution comprising pseudo-wellastonite or rankinite. Preferably, such a solid solution has a composition within or at the following molar weight percentage limits:

| | | |
|---|---|---|
| $45 \leqslant$ | $SiO_2$ | $\leqslant 64$ |
| $36 \leqslant$ | CaO | $\leqslant 55$ |
| $0 <$ | $Al_2O_3$ | $\leqslant 10$, |

especially:

| | | |
|---|---|---|
| $48 \leqslant$ | $SiO_2$ | $\leqslant 55$ |
| $45 \leqslant$ | CaO | $\leqslant 52$ |
| $0 <$ | $Al_2O_3$ | $\leqslant 7$. |

The preferred alumina content of such a solid solution is less than 5 mole %.

The single drawing figure shows a phase diagram illustrating the range of composition of component (i) in the flux.

Fluxes of the present invention generally contain 40% to 80% by weight of the mixture of (i) and (ii). Desirably, (i) and (ii) are present in a form in which 95% is of particle size less than 250 microns.

Component (ii) may comprise up to 45% by weight of the flux and have a melting point between 700° and 1300°C. Generally (ii) comprises sodium carbonate, potassium carbonate, sodium fluoride, aluminium fluoride, potassium fluoride, lithium fluoride, cryolite, fluorite, boric acid and borates. These low melting fluxing agents reduce the melting point of the final flux and may be used to control the variation of the viscosity of the flux with temperature.

This invention also provides a method of casting molten metal in a mould, which method comprises adding to the mould prior to, during or after teeming a mould flux which comprises:

i. wollastonite;

ii. at least one low melting fluxing agent;

particularly wherein the casting is continuous casting of steel. Generally the flux is applied at the rate of 0.5 to 1.5 Kg per 1000 Kg.

Synthetic wollastonite may be prepared, for example by hydrothermal treatment of an aqueous suspension of calcium oxide and silica in an autoclave followed by dehydration of the resulting calcium silicate hydrate. Natural wollastonite is generally found in granite and lime containing areas.

Because component (i) of a flux of this invention has a composition which is both substantially uniform in a given batch and reproducible from other batches the properties of the mould flux may be controlled with relative ease. Furthermore, a flux according to the present invention is found to be capable of absorbing up to 30% by weight of alumina or other inclusions in the cast metal without significant alteration in its viscosity or melting point. This surprising advantage is believed to result from the fact that the range of composition of (i) in use in the flux approximates to the eutectic valley system EFGH shown in the accompanying phase diagram. Thus, when the absorption of, for example, alumina inclusion from the melt alters the initial composition of (i), the composition probably progresses essentially along EFGH. The eutectic melting temperatures at points FGH are given on the phase diagram and it will be seen that (a) they do not differ greatly and thus (b) will be unlikely to alter significantly the viscosity of the flux.

Moreover, a flux of the present invention has good lubricating properties and thus, by using such fluxes, metals having a good surface finish may be obtained. This is further aided by the use of a flux according to the present invention having a narrow melting range. This prevents the formation of crust around the edges of the solidifying metal, which crust may become entrapped between the mould and metal causing "breakouts". Wollastonite is particularly useful in this respect since, even with absorption of relatively large quantities of included material, its melting point remains substantially constant.

In contrast to fly ash-based fluxes the present fluxes do not contain a high proportion of carbon. Accordingly, they are particularly useful in the casting of low carbon steel.

Light-weight refractory materials, i.e. low density alumino silicates, may also be included in the novel fluxes, generally in amount up to 15% by weight. These materials serve to decrease the density of an improve the flowability of the final flux. Suitable materials include for example expanded vermiculite, perlite and pumice.

To control the rate of melting of the flux it may be desirable to add, e.g. in amount up to 20% by weight, carbonaceous powder. The inclusion of carbonaceous powder reduces the rate of melting of the flux. Typical carbonaceous powders include charcoal powder, coke powder, anthracite powder and graphite. Preferably the carbonaceous powder is coke powder.

Generally the flux of the present invention comprises:

| | |
|---|---|
| Wollastonite | 30% – 90% by weight |
| low melting fluxing agent | 0% – 45% by weight |

-continued

| | |
|---|---|
| light weight refractory material | 0% – 15% by weight |
| carbonaceous powder | 0% – 20% by weight |

Particularly preferred are fluxes containing:
50% – 75% by weight wollastonite
4% – 20% by weight perlite and
1% – 12% by weight sodium carbonate.

The actual composition of the flux will depend upon the condition of its envisaged use.

The following Examples illustrate the present invention.

EXAMPLE 1

A mould flux of the following composition was applied to the surface of molten carbon steel in the continuous casting of the steel.

| | |
|---|---|
| Wollastonite | 70% by weight |
| Cryolite | 10% by weight |
| Sodium carbonate | 10% by weight |
| Perlite | 5% by weight |
| Coke powder | 5% by weight |

0.5 Kg of the above mould flux was applied per 1,000 Kg of carbon steel. The surface of cast steel was clean and free from cracks. In contrast steel cast using fly ash based fluxes often resulted in the occurrence of minute cracks below the oscillation mark on the casting surface.

EXAMPLE 2

A mould flux of the following composition was applied to the surface of molten low carbon stainless steel in the continuous casting of the steel.

| | |
|---|---|
| Wollastonite | 74% by weight |
| Cryolite | 10% by weight |
| Sodium carbonate | 10% by weight |
| Perlite | 6% by weight |

0.8 Kg of the above mould flux was applied per 1,000 Kg of low carbon stainless steel. The cast steel was free from surface cracks.

EXAMPLE 3

A mould flux of the following composition was used in continuous casting low carbon aluminium killed deep drawing steels.

| | |
|---|---|
| Wollastonite | 54.0% by weight |
| Perlite | 5.0% by weight |
| Sodium carbonate | 7.2% by weight |
| Borax | 10.8% by weight |
| Fluorspar | 7.2% by weight |
| Millscale | 6.3% by weight |
| Graphite | 9.5% by weight |

0.65 Kg of the above mould flux was applied per 1,000 Kg of the low carbon steel.

EXAMPLE 4

A mould flux of the following composition was used in continuous casting low carbon aluminium killed deep drawing steels.

| | |
|---|---|
| Wollastonite | 63.7% by weight |
| Perlite | 11.7% by weight |
| Sodium carbonate | 2.3% by weight |
| Borax | 9.7% by weight |
| Fluorspar | 4.9% by weight |
| Millscale | 4.8% by weight |
| Graphite | 2.9% by weight |

0.65 Kg of the above mould flux was applied per 1,000 Kg of the low carbon steel.

We claim:

1. A method of casting molten metal in a mould, which method comprises adding to the mould prior to, during or after teeming a mould flux which is in the form of a flowable powder mix consisting essentially of in particulate form:

i. wollastonite;
ii. at least one low melting fluxing agent;
iii. a low density refractory material; the proportion by weight of low density refractory material being at most 15% and the proportion by weight of any alumina ($Al_2O_3$) in the overall composition being not more than 10% by weight.

2. A method according to claim 1 wherein the casting is continuous casting of steel.

3. A method according to claim 1 wherein (i) is essentially pure synthetic or natural $CaO.SiO_2$.

4. A method according to claim 1 wherein (i) is $CaO.SiO_2$ in solid solution with at least one of $SiO_2$, CaO and $Al_2O_3$.

5. A method according to claim 4 wherein the solid solution comprises a phase selected from the group consisting of pseudo-wollastonite and rankinite.

6. A method according to claim 4 wherein the solid solution has a composition within or at the following molar weight percentage limits:

$$45 \leqslant SiO_2 \leqslant 64$$
$$36 \leqslant CaO \leqslant 55$$
$$0 < Al_2O_3 \leqslant 10.$$

7. A method according to claim 6 wherein the molar weight percentage limits are:

$$48 \leqslant SiO_2 \leqslant 55$$
$$45 \leqslant CaO \leqslant 52$$
$$0 < Al_2O_3 \leqslant 7.$$

8. A metod according to claim 1 wherein (i) comprises less than 5 mole % $Al_2O_3$.

9. A method according to claim 1 wherein the flux contains from 40% to 80% by weight of the mixture of (i) and (ii).

10. A method according to claim 1 wherein (ii) comprises up to 45% by weight of the flux and has a melting point between 700° and 1300°C.

11. A method according to claim 10 wherein (ii) comprises a compound selected from the group consisting of sodium carbonate, potassium carbonate, sodium fluoride, aluminum fluoride, potassium fluoride, lithium fluoride, cryolite, fluorite, boric acid and a borate.

12. A method according to claim 1 wherein the low density refractory material comprises a material selected from the group consisting of expanded vermiculite, perlite or pumice.

13. A method according to claim 1 wherein the flux contains up to 20% by weight of carbonaceous powder.

14. A method according to claim 13 wherein the carbonaceous powder is a powder selected from the group consisting of charcoal powder, coke powder, anthracite powder and graphite.

15. A method according to claim 1 wherein the flux contains from 50% to 75% by weight (i), from 4% to 20% by weight perlite and from 1% to 12% by weight sodium carbonate.

* * * * *